United States Patent [19]

Perez

[11] 4,121,386

[45] Oct. 24, 1978

[54] MANUAL SURFACE TREATING DEVICE

[76] Inventor: Jose L. Perez, 150-A W. Eckerson Rd., Spring Valley, N.Y. 10977

[21] Appl. No.: 685,655

[22] Filed: May 12, 1976

[51] Int. Cl.[2] ..... B24D 15/04

[52] U.S. Cl. ..... 51/392; 15/209 R; 51/394

[58] Field of Search ..... 51/358, 391–393, 51/401, 394, 407, 205 R; 15/209 R, 244 R, 258; 34/93.1, 95.2, 95.4

[56] References Cited

U.S. PATENT DOCUMENTS

| | | | |
|---|---|---|---|
| 1,146,359 | 7/1915 | Smith | 51/401 |
| 2,231,453 | 2/1941 | Pitar | 51/392 |
| 2,414,535 | 1/1947 | Kaufman | 51/392 |
| 3,131,410 | 5/1964 | Anderson | 15/258 X |
| 3,623,282 | 11/1971 | Norris | 15/104.94 X |
| 3,775,923 | 12/1973 | Martin | 51/392 |

FOREIGN PATENT DOCUMENTS

| | | | |
|---|---|---|---|
| 699,918 | 11/1953 | United Kingdom | 34/95.4 |

*Primary Examiner*—N. P. Godici
*Attorney, Agent, or Firm*—Philip Furgang

[57] ABSTRACT

Disclosed is a manual, disposable sandpaper device. Cut and formed from a single blank of cardboard, a rectangular member is creased to be folded upon itself to form a rigid member with two free surfaces. Adhered to one surface is a sheet of sandpaper. Cut into the upper member is an integrally formed pair of tabs joined at a common, centrally disposed crease line.

16 Claims, 6 Drawing Figures

MANUAL SURFACE TREATING DEVICE

BACKGROUND OF THE INVENTION

This invention relates to manually operated devices for treating the surface of a work object and, more particularly, is directed to devices of this nature intended to sand, polish, wax, or the like such surfaces.

An age-old method of sanding or otherwise treating a work surface has been to take the material with which the surface is to be treated and manually hold it to a block of wood or the like. Thus, with particular reference to sanding, the sandpaper is generally wrapped over a block of wood of a desired configuration. The user grasps the sandpaper and the block with his hand. Usually, the combination is found to be useful, but clumsy. This age-old method requires the retaining of the block of wood. Furthermore, and more importantly, it is desirable to have a sanding or other work surfaces treating device which is, at once, disposable and efficient in use. An essential characteristic of such a device must be that the material used to treat the work surface is substantially continuous and relatively unyielding so that the manual application of force will be evenly applied to the work surface.

There have been a number of attempts to accomplish the dual goals of providing a sandpapering or other work surface treating device which is, at once, efficient in use and, by the nature of its construction, disposable. The previous devices have had, however, certain disadvantages. Thus, for example, Smith, in U.S. Pat. No. 1,146,359, provides for a trifoliate structure, made of three separate leaves of sandpaper, each secured to one another. Each sheet of sandpaper is divided in half, with one half of a sheet of sandpaper secured to the other half of a second sheet of sandpaper. The remaining halves of the first and second sheets of sandpaper are, in turn, secured to a third sheet of sandpaper. Each trifoliate sandpaper sheet has an exposed sanding surface. Smith teaches that this structure is substantially rectangular, "Y" or "T" shaped in cross section, and folded along the length thereof.

Kaufman, in U.S. Pat. No. 2,414,535, attempts another approach. Kaufman teaches a sheet of sandpaper secured to a rigid backing sheet made of cloth or paper. The device is substantially rectangular and perforated along parallel lines. Kaufman teaches that a handle may be formed by folding up the marginal parallel strips of the backing, thereby leaving exposed the sandpaper sheet on either side and a portion of the sandpaper secured to the backing sheet between the marginal strips.

Still another example is provided by Norris III, in U.S. Pat. No. 3,623,282. There, Norris III forms a triangularly shaped member which is grasped between the thumb and forefinger by the user. Each sheet which makes up the member is flexible. The pyramidal structure is so flexible that it can only be conveniently used within the tiny confines described by the distance between the thumb and forefinger of the user. Any larger area provides a wholly flexible, non-rigid surface which distributes forces unequally to the work surface.

Each of these aforementioned devices, in its own way, presents significant disadvantages. The sanding surface suggested by Smith is discontinuous, separated and weakened by a fold line. Further, the user is required to grasp treatment surfaces (e.g. sandpaper), making such use uncomfortable, at the very least. The device proposed by Kaufman leaves the marginally exposed sandpapering sheet, amounting in many cases to almost ⅔ of the area of sandpaper, unsupported by the backing sheet, thereby forming a very inefficient device. Further, the handle formed by the marginal strips of backing sheet requires support by either an index finger or block of wood disposed between. It should be noted that it is the obvious goal of any disposable sanding device to avoid the use of added tools, such as a strip of wood, in order to make the sanding device workable. Thus, there is little difference between the device of Kaufman and the age-old combination of sandpaper and a block of wood. In the device proposed by Norris III, the effective area use is only in the relatively small area described between the thumb and forefinger of the person holding the device. Furthermore, because the pyramidal structure is a three-sided, triangular, flexible sheet, very little useful rigid pressure can be brought against the surface of the work object.

SUMMARY OF THE INVENTION

It is an object of this invention to provide a surface treating device which is economical in manufacture and efficient in use, thereby providing a unitary, disposable item.

It is a further object of this invention to provide a surface treating device which may be constructed from a continuous paper or plastic blank.

In the fulfillment of these and other objects—there is provided a hand-held surface treating device which is made of at least a first and second substantially planar member. Each of the members is secured to one another and lies in parallel planes. There is further provided means for treating the surface of a work object. The surface treating means are secure to the free surface of one of the two planar walls. There is provided at least one tab member defined by slits in the second member and hingedly joined along one marginal edge of the tab. There is thereby provided at least one handle integrally formed as a part of the second member.

In another aspect of this invention, there is provided at least a first substantially planar continuous member. There is also provided at least a first and second "L"-shaped member. Each leg of each "L"-shaped member extends in planes at right angles to one another. The first planar member has secured thereto one leg of each of the "L" shaped members. The remaining legs of the "L" shaped members are secured to one another, to thereby form a handle. There are also means for treating the surface of a work object. The surface treating means are secured to the free surface of the first planar member.

In still another aspect of this invention, there is provision for a continuous substantially planar member which is folded upon itself to provide at least two planar conjoined wall-like members. Means are provided for treating the surface of a work object. The surface treating means are secured to the first of the walls. There are also provided means integrally formed in the second wall and hingedly joined thereto, so as to form a handle for manually grasping the device.

DESCRIPTION OF THE PREFERRED EMBODIMENTS

Figure 1:
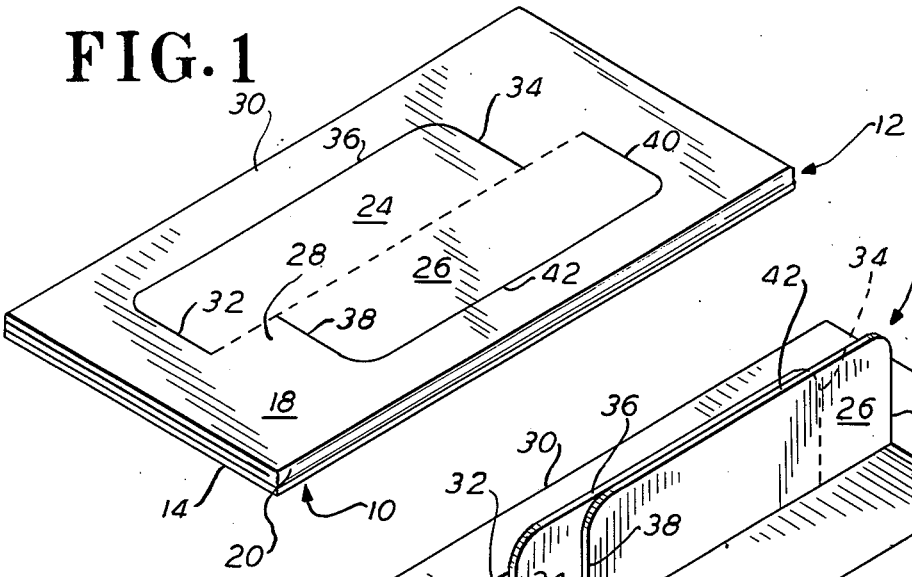
FIGS. 1 and 2 are perspective views of a surface treating device constructed in accordance with the teachings of this invention.

Turning now to the drawing, there are disclosed two embodiments (FIGS. 1, 2 and FIGS. 3, 4, respectively) of work surface treating devices of this invention. Surface treating devices may include devices for sanding, applying wax, stain, or the like to work surfaces of such material as wood. Preferably, the devices of this invention are particularly applicable to manual, disposable sandpapering devices.

Turning to the first embodiment, there is disclosed such a device 10, which provides a support member 12 to which may be adhered a sheet 14 of the surface treating material. Preferably, the sheet would be a common sandpaper. The support member 12 may be constructed of any rigid material such as plastic, cardboard, or the like. Preferably, the support member 12 is made of a cardboard sheet which is cut from a larger cardboard blank. This support member 12 preferably has a rectangular shape. Thus, it will be appreciated that, if the support member 12 is cut from a larger rectangular blank, appropriately proportioned, there will be no waste in the forming of each of the support member blanks 12.

Figure 2:
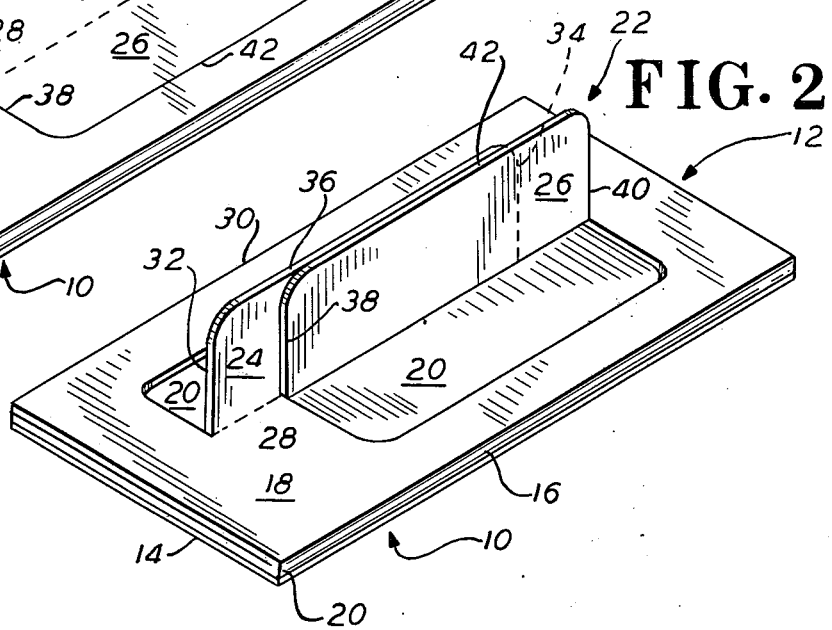

As indicated above, each support member 12 is preferably a rectangular sheet of cardboard. Centrally disposed along the length thereof is a crease line 16 which divides the support member 12 into two equal parts 18 and 20, respectively. The second part 20 provides a continuous and uninterrupted planar member. The first part 18 may have cut therein and formed, as an integral part thereof, a tab or other handle means 22 (FIG. 2). The handle means 22 may be made of two tabs 24 and 26 cut into the first part 18 of the support blank 12. The method of cutting the handle means 22 or support member 12 is well known in the art.

Preferably, the tabs 24 and 26 may be disposed about a hinge line 28. This hinge line 28 may be centrally disposed in the first part 18 and parallel the longer side defined by the central crease line 16 and a marginal edge 30 parallel to the hinge 16.

Each tab 24 and 26 may preferably have a generally "U"-shaped configuration. Thus, the sides 32 and 34 of the first "U"-shaped tab 24 are defined by cuts in the first part 18 which extend perpendicularly from the hinge line 28 and terminates so as to be spaced from the marginal edge 30. The remainder of the "U" shape of the first half 24 is completed by a cut 36 in the first part 18 extending substantially parallel to the hinge line 28. These cuts 32, 34, and 36 may be made by die cutting or other similar means well known in the art.

In a similar manner, the second tab 26 may be defined by cuts 38, 40, and 42 in the first part 18 of the support blank 12. The sides 38 and 40 of the "U"-shaped second tab 26 may preferably extend perpendicularly from the hinge line 28 and spaced from the crease line 16. These two cuts 38 and 40 are joined by the third cut 42 which completes the "U" shape of the second tab 26. The first perpendicular cut 38 of one side of the "U"-shaped second tab 26 may be spaced between the opposed sides 32 and 34 of the first tab 24 while the second side 40 is spaced outside of the opposed sides 32 and 34 of the first tab 24.

In assembly, the blank 12 is folded at the crease line 16 and the opposed parts 18 and 20 may be secured to one another by glue or other well known joining means. A sheet of sandpaper 14 preferably having the dimensions of the parts 18 and 20 is adhered to the underside (not completely visible) of the second part 20 with the sandpaper surface exposed. The tabs 24 and 26 may be lifted from the member 12 at the hinge line 28, thereby providing the handle means 22.

In use, the user merely pulls up the tabs 24 and 26 to grasp the handle 22 formed thereby. The continuously rigid second part 20 provides a strong support for the sandpaper 14. Once used, the entire assembly 10 may be thrown away. Because this device 10 is made of cardboard or similarly inexpensive material, there is provided an inexpensive, disposable sandpapering (or other work surface treating) device.

Turning to another embodiment, there is shown a device 50. As before, a support member 52 is provided in order to lend firm support to the sandpaper 14 (or other surface-treating substance). (The identical numerals indentify identical items as shown in previous embodiments of this invention.)

As with the previous device 10 (FIGS. 1 and 2), the support member 52 may be made of any inexpensive material such as plastic, cardboard, or the like. In like manner, it may be formed from a rectangular sheet of cardboard in the form of a much larger blank.

As preferably disclosed herein, the support member 52 is rectangular in shape. Parallel crease lines are so disposed as to preferably divided the blank 52 into two pairs of equally dimensioned substantially rectangular panels 54 and 56 and 58 and 60 on either side of a larger, centrally and symmetrically disposed rectangular panel 62. Each of the side panels 54, 56, 58, and 60 may be preferably one half the width of the central panel 62. Thus, the panels 54 and 58 are defined by respective marginal edges 64 and 66, respectively. A crease line 68 hingedly joins the one side panel 54 to the second side panel 56. A second parallel crease line 70 joins the second panel 56 to the central panel 62, thereby defining the two side panels 54 and 56 on one side of the central panel 62. In the same manner, the parallel crease line 72 separates and defines the panel 58 from the fourth panel 60. A final crease line 74 defines the last panel 60 from the central panel 62.

Figure 3:
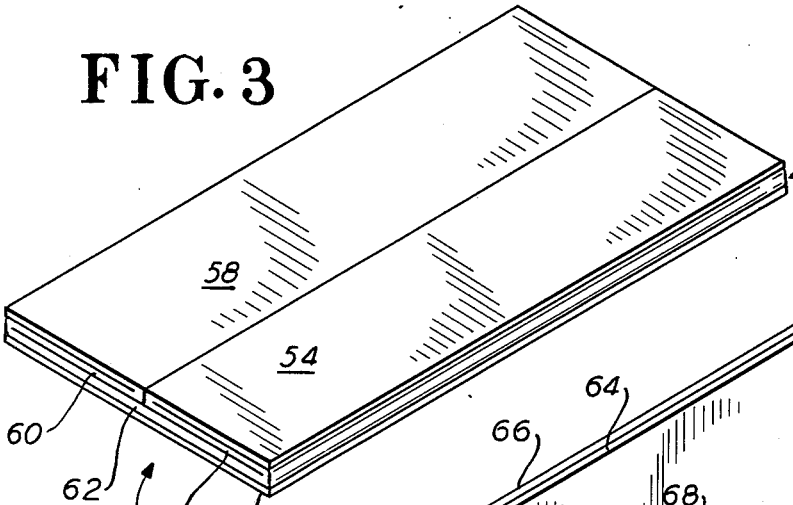
FIGS. 3 and 4 are perspective views of still another device constructed in accordance with the teachings of this invention.
Figure 4:
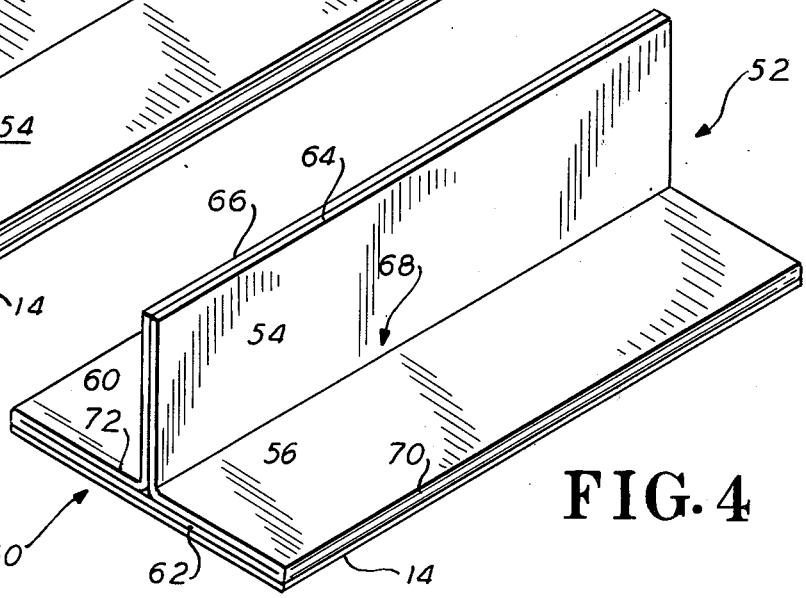

In assembly, the adjoining pairs of panels 54, 56, and 58, 60 are folded upon themselves such that the panels 56 and 60, hingedly joined along parallel sides of the central panel 62, are folded over and secured to that central panel 62 as by adhesive or other joining means. The panels 54 and 58, adjacent and hingedly joined to panels 60 and 56 respectively, may be secured to one another. In the alternative, these two exterior panels 54 and 58 may be left unsecured (FIG. 3).

With the exterior panels 54 and 58 in a raised position (FIG. 4), there is formed the central panel 62 secured to two "L"-shaped panels 58, 60 and 54, 56, respectively. The "L"-shaped panels are disposed in a mirror image relationship. The upstanding legs 54 and 58 of the "L"-shaped panels thereby form a handle. These "L"-shaped panels 58–60, 54–56, respectively, can be, as indicated, secured to one another or left unsecured and merely held together by the user. The sandpaper 14 may be secured to the free surface of the central panel 62.

It will be immediately apparent with respect to both embodiments (FIGS. 1 and 2 or FIGS. 3 and 4) that it is not necessary for a separate surface treating material, such as sandpaper 14, to be used. The free surface of each blank, namely part 20 (FIGS. 1 and 2) or central panel 62 (FIGS. 3 and 4) may be impregnated with the material treating substance. It is to be further understood that the dimensions and general configuration may be changed. Thus, the rectangular shape may be square, circular, etc. Thus, tabs 24 and 26 of the first device 10 (FIGS. 1 and 2) is intended to give maximum strength to the handle as cut in the first part 18. However, the tabs 24 and 26 may be disposed with the "U"-shaped walls 32 and 34 of one tab 24 between the "U"-shaped walls 38 and 40 of the other, providing, however, a much weaker handle 22. Further, it will be understood that in both embodiments the folded over members may, instead, comprise separate distinct parts, each adhered to one another, rather than a continuous member. It will also be understood that the embodiment of FIG. 4 may be formed such that the central panel 62 may be disposed at one end of the blank 52 with panels 56, 54, 62 and 60 disposed in an adjacent relationship and folded continuously with crease lines formed at the junction of panels 62 and 56, 56, and 54, 54 to 58, and 58 to 60. In this alternative relationship, one marginal edge will appear at one free side of the panel 62 and at the now free edge of the last panel 60, respectively. Save for these differences, the folded combination will appear as it does in FIG. 4.

Figure 5:
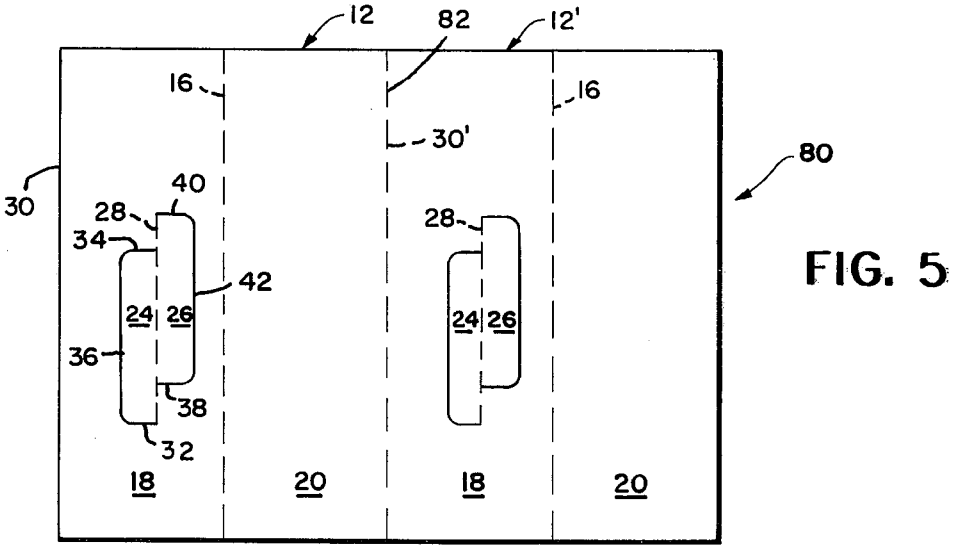
FIG. 5 is a top plan view of a blank, constructed in accordance with the teachings of the device disclosed in FIGS. 1 and 2.
Figure 6:
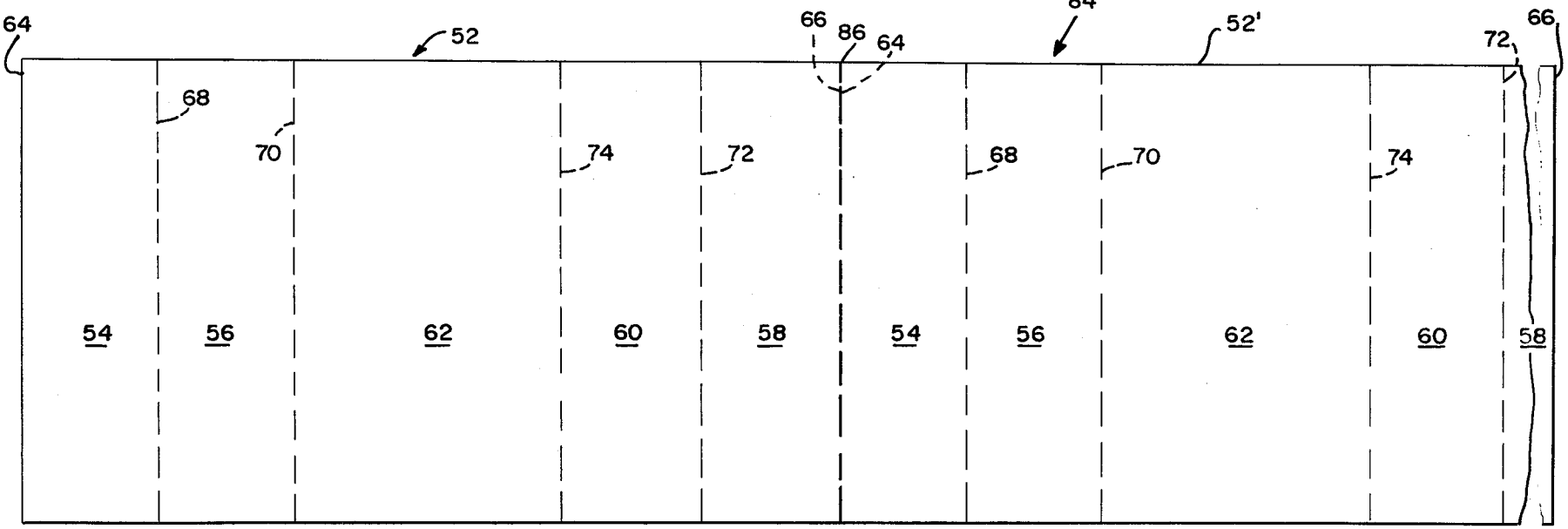
FIG. 6 is a top plan view of a blank, constructed in accordance with the teachings of the device disclosed in FIGS. 3 and 4.

Returning to the embodiment of FIGS. 1 and 2, the support member 12 can be, as previously indicated, made from a blank 80 which may be made of cardboard or the like (FIG. 5). Thus, separate support members 12 and 12' may be separated from one another by a serrated or die-cut line 82 in the blank 80, as is well known in the art. In this manner, the marginal edge 30 would thus be formed for one support member 12 at the exposed edge of the blank 80, while the other marginal edge 30' would be formed at the serrated edge 82, joining the two support members 12 and 12'. Obviously, other such support members may be formed in such a blank and attached to any side of any support member 12, as is well known in the art.

In a like manner, a blank 84 may have a plurality of support members 52 and 52', each joined by a serrated edge 86 (only one is shown in FIG. 5). These support members 52 and 52' conform to the device of FIGS. 3 and 4. Thus, the blank 84 comprises, in this preferred example, two joined support members 52 and 52', from which may be formed the device of FIGS. 3 and 4. Thus, the one exposed marginal edge 64 of the panel 54 of the support members 52 would be exposed. The two joined support members 52 and 52' are joined by a serrated line 86, and the exposed marginal edges 66 of the support member 52 and 64 of the blank 52' are joined at the common serrated edge 86. It is well known in the art to attach other blanks to any edge of the support members 52 or the blank 84 to make a larger blank from which may be formed other support members.

What is claimed is:

1. A hand-held device for treating the surface of a work object comprising:

(a) at least first and second substantially planar members disposed and secured to one another so as to be parallel to one another;

(b) means for treating the surfac of the work object secured to the free planar surface of said first member; and (c) handle means which comprises at least one tab being defined by apertures formed within said second member, said tab being hingedly secured within said planar surface of said second parallel member, said portion of said second surface surrounding said tab being secured to said first member so as to maintain said parallel relationship.

2. A hand-held device as recited in claim 1 wherein said first and second members comprise a single, continuous blank hingedly joined at a crease line and folded upon itself.

3. A hand-held device as recited in claim 2 where handle means comprises two of said tabs hingedly secured at a common crease.

4. A hand-held device as recited in claim 3 wherein said tabs are substantially "U" shaped, said material treating means comprises sandpaper.

5. A hand-held device as recited in claim 4 wherein said blank comprises cardboard having a rectangular configuration, said crease line dividing said blank into two equally dimensioned members, said crease line joining said tabs being symmetrically disposed in said first member.

6. A hand-held device for treating the surface of a work object comprising:

(a) one continuous substantially planar member folded upon and secured to itself thereby providing conjoined wall-like members;

(b) means, for treating the work surface, secured to an exposed continuous planar rigid surface of a first of said wall-like members; and (c) means, integrally formed in a second of said wall-like members, and hingedly joined thereto so as to form a handle for manually grasping said device.

7. A manually manipulatable device for treating the surface of a work object comprising:

(a) at least a first substantially rigid, planar, continuous member;

(b) first and second "L"-shaped members disposed in mirror image relationship to one another, said "L"-shapes comprising conjoined planar walls;

(c) one upstanding leg of each of said "L"-shaped members being placed adjacent to one another; the other of said legs being disposed upon and secured to said first member such that said upstanding legs form a handle; and (d) means for treating the work object surface, secured to the exposed planar surface of said first member.

8. A manual device as recited in claim 7 wherein said first member and said "L"-shaped members are integrally formed from a single blank.

9. A manual device as recited in claim 8 wherein said "L"-shaped members are hingedly joined to each other at a crease line defining the marginal edge of the top of said upstanding legs and one of said legs being hingedly joined to said first member at a second crease line.

10. A manual device as recited in claim 8 wherein each of said other legs of said "L"-shaped members being hingedly joined at the marginal edge by crease lines to said first member.

11. A manual device as recited in claim 10 wherein said first member being rectangular; said other legs of said "L"-shaped members have, taken together, a length substantially equal to the width of said first member and said upstanding legs are of equal length.

12. A manual device as recited in claim 11 wherein said first member and "L"-shaped members being made of cardboard, said treating means comprises sandpaper.

13. A blank from which may be formed a plurality of hand-held devices comprising:

(a) a plurality of rectangular members, each one of said members being removably joined to at least one other of said rectangular members;

(b) each of said members having centrally and symmetrically disposed crease lines dividing said members into substantially rectangular equal parts;

(c) one of said two equal parts having disposed therein a central crease line symmetrically disposed and parallel to one side thereof; and (d) at least one tab formed within said one part and joined thereto at said central crease line.

14. A blank as recited in claim 13 wherein there being two "U"-shaped tabs being disposed in mirror image relationship to one another with the legs thereof terminating at said central crease line, said legs of each said tabs being offset such that only one of said legs of one of said tabs being disposed between said legs of said other tab.

15. A blank from which may be formed a plurality of hand-held devices comprising:

(a) a plurality of rectangular members, each one of said members being releasably secured to at least one other of said members;

(b) each of said members having a plurality of parallel crease lines defining adjacent continuous and planar rectangular panels within each of said members;

(c) a first of said panels being rigid and centrally disposed;

(d) a pair of second rectangular panels, each defined by a crease line on opposed sides of said first panel, such that said first pair of second panels may be folded upon one side of said first panel; and (e) a pair of third rectangular panels each being joined by crease lines to one of said second panels such that said third panels being foldable upon the sides of said second panels opposed to said first panel.

16. A blank as recited in claim 15 wherein said second and third panels are each equally dimensioned and one-half the area of said first panel.

* * * * *